United States Patent [19]

Nakamura

[11] 3,958,967

[45] May 25, 1976

[54] MOTOCYCLE SPARK ARRESTOR

[75] Inventor: David S. Nakamura, Garden Grove, Calif.

[73] Assignee: Bassani Manufacturing, Anaheim, Calif.

[22] Filed: Aug. 2, 1974

[21] Appl. No.: 494,220

[52] U.S. Cl. ..... 55/490; 55/505; 55/529; 55/DIG. 20; 55/DIG. 30; 110/119

[51] Int. Cl.[2] ..... B01D 39/10

[58] Field of Search ..... 55/490, 495, 505, 511, 55/529, DIG. 20, DIG. 30, 500, 503, 502, 506, 525, 507; 110/119; 23/288 F; 60/272, 309, 311; 210/435, 446; 181/36 B, 36 C

[56] References Cited

UNITED STATES PATENTS

| | | | |
|---|---|---|---|
| 488,864 | 12/1892 | Zimmerman | 55/DIG. 20 |
| 561,695 | 6/1896 | Bright | 55/DIG. 20 |
| 568,735 | 10/1896 | Bright | 55/DIG. 20 |
| 2,940,538 | 6/1960 | Billey | 181/63 |
| 3,254,477 | 6/1966 | Rogers, Jr. | 55/525 X |

FOREIGN PATENTS OR APPLICATIONS

| | | | |
|---|---|---|---|
| 7,090 | 11/1905 | United Kingdom | 210/446 |

*Primary Examiner*—Frank W. Lutter
*Assistant Examiner*—David L. Lacey
*Attorney, Agent, or Firm*—Philip M. Hinderstein

[57] ABSTRACT

A motorcycle spark arrestor comprising a cylindrical housing connectable to the motorcycle exhaust pipe and a screen positioned in the housing so as to intercept all the exhaust gases flowing therethrough, the screen including a planar, rectangular, central section positioned parallel to the longitudinal axis of the housing and contacting the opposite sides thereof, and first and second planar end sections made integral with the opposite ends of the central section and extending in opposite, parallel directions therefrom, at an obtuse angle thereto, the free ends of the end sections contacting the housing.

6 Claims, 3 Drawing Figures

FIG. 1.
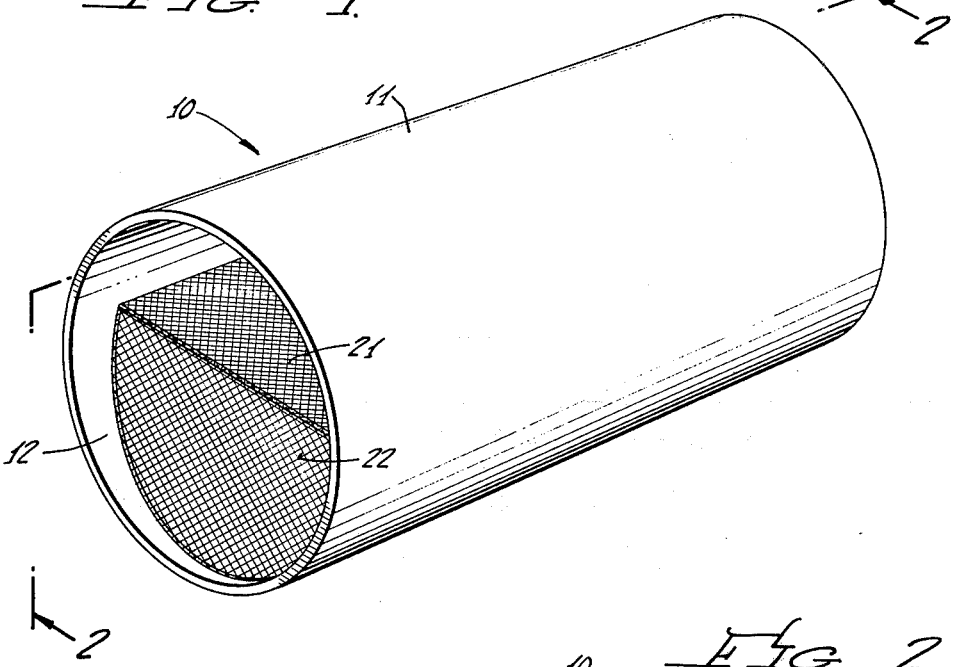
FIG. 2.
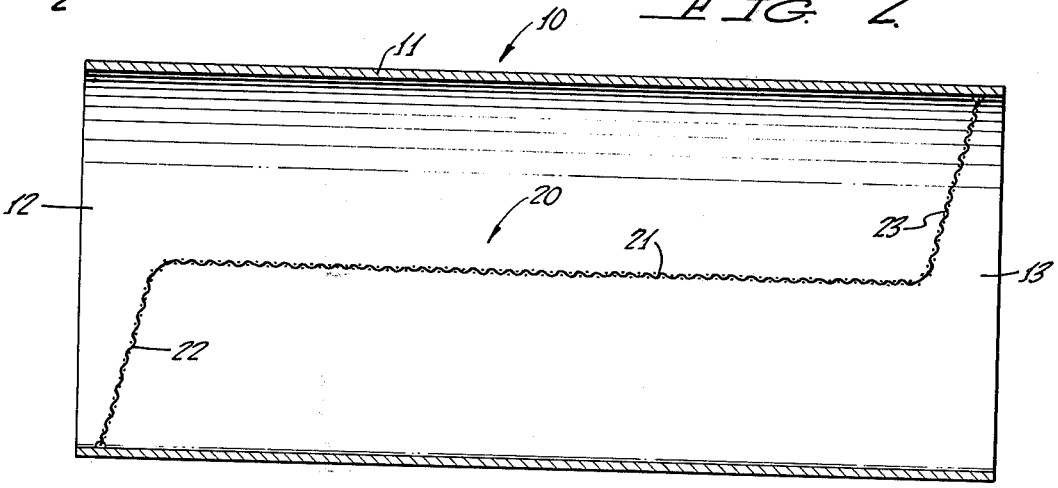
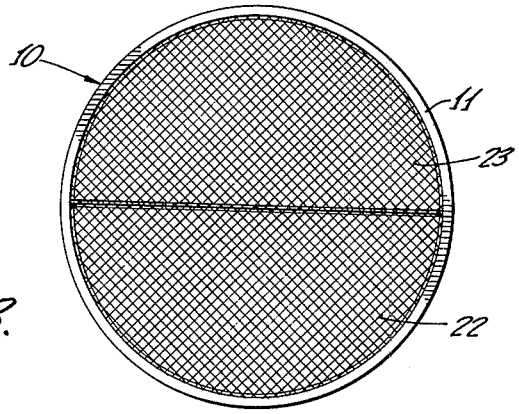
FIG. 3.

MOTOCYCLE SPARK ARRESTOR

BACKGROUND OF THE INVENTION

1. Field of the Invention.

The present invention relates to a motorcycle spark arrestor and, more particularly, to a self-cleaning, long-lasting, low back pressure spark arrestor for use with motorcycles and the like.

2. Description of the Prior Art.

Federal Law requires all motorcycles used in National Parks to have a spark arrestor. The spark arrestor must have the capability of removing 80% of all carbon particles greater than 0.023 inches. Since the carbon particles accumulate within the arrestor, it must also be periodically cleaned.

As a result of the above requirements, two types of spark arrestors have been developed for use on motorcycles. The first is the purely mechanical type having a series of baffles and other elements to prevent the hot carbon particles from escaping. However, such types present too much of a restriction to the exhaust gases to permit their use with many high performance motorcycles and, as a result, mechanical types are not widely used.

The screen type consists of a stainless steel screen through which the exhaust gases pass. While th simplest screen type could include a planar, cylindrical screen positioned normal to the longitudinal axis of the exhaust pipe, such a screen is not possible since Federal regulations require the open area of the screen to be at least twice the area of the exhaust port of the motorcycle engine. Therefore, in order to provide a sufficient area, the most common type of screen type spark arrestor includes a cone inserted in the tail pipe with the pointed end of the cone facing forward. However, while this type of spark arrestor meets federal requirements, the sharp edge in the path of the hot exhaust gases eventually burns up and steps must be taken to prevent this from happening, increasing the complexity and cost of the spark arrestor.

SUMMARY OF THE INVENTION

According to the present invention, these problems are solved by providing a novel screen type motorcycle spark arrestor. The present spark arrestor is not only cleanable, but it is self-cleaning. The present spark arrestor uses a screen having a configuration which presents no sharp edges or points to the flow of hot exhaust gases and is, therefore, durable and long-lasting. Furthermore, as is the case with most screen type spark arrestors, the present spark arrestor presents virtually no back pressure and is ideal for use in high performance motorcycles.

Briefly, the present motorcycle spark arrestor comprises a cylindrical housing connectable to the motorcycle exhaust pipe and a screen positioned in the housing so as to intercept all the exhaust gases flowing therethrough, the screen including a planar, rectangular, central section positioned parallel to the longitudinal axis of the housing and contacting the opposite sides thereof, and first and second planar end sections made integral with the opposite ends of the central section and extending in opposite, parallel directions therefrom, at an obtuse angle thereto, the free ends of the end sections contacting the housing.

OBJECTS

It is therefore an object of the present invention to provide a motorcycle spark arrestor.

It is a further object of the present invention to provide a self-cleaning, durable, efficient motorcycle spark arrestor.

It is a still further object of the present invention to provide a reversible motorcycle spark arrestor.

It is another object of the present invention to provide screen type motorcycle spark arrestor having no sharp edges or points in the flow of the hot exhaust gases.

Still other objects, features and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a perspective view, partially broken away, of a motorcycle spark arrrestor constructed in accordance with the teachings of the present invention;

FIG. 2 is a longitudinal sectioned view of the motorcycle spark arrestor of FIG. 1; and FIG. 3 is an end view of the motorcycle spark arrestor of FIG. 1.

DESCRIPTION OF THE PREFERRED EMBODIMENT

Referring now to the drawings, there is shown a motorcycle spark arrestor, generally designated 10, including an elongate, hollow, cylindrical housing 11 being open at the opposite ends 12 and 13 thereof. Either end 12 or 13, is adapted to be connected to the exhaust pipe of a motorcycle or the like by means of clamps or brackets or any other means well known to those skilled in the art.

Motorcycle spark arrestor 10, also includes a screen, generally designated 20, which is preferable made from stainless steel and having a gage sufficient to satisfy the Federal requirements of blocking eighty percent (80%) of all carbon particles in excess of 0.023 inches. Screen 20 is positioned in housing 11 so as to intercept all of the exhaust gases flowing therethrough. Screen 20 includes a planar, rectangular, central section 21 which is positioned parallel to the longitudinal axis of housing 11 and having a width equal to the inside diameter of housing 11 so as to contact the opposite sides thereof. On the other hand, the width of central section 21 may be narrower than the largest inside diameter of housing 11 so as to be positioned parallel to but spaced from the axis of housing 11 if desired. In either event, the length of central section 21 is determined by the desired area of screen 20.

Screen 20 also includes first and second planar end sections 22 and 23 which are made integral with the opposite ends of central section 21 and which extend in opposite, parallel directions therefrom, at an obtuse angle thereto which is preferably between 100° and 120°. The general shape of end sections 22 and 23 is semi-eliptical so that the ends thereof which are not connected to central section 21 contact the inside of housing 11, as shown in FIGS. 1 and 3. With such a configuration, screen 20 may be connected to housing 11 by welding the outer circumference of screen 20 to the inside surface of housing 11 since the entire length of such circumference is in intimate contact with the inside of housing 11.

Because of the configuration of screen 20, and, more particularly the fact that central section 21 is parallel to the longitudinal axis of housing 11, screen 20 may have any desired length in order to provide an area which is at least twice the area of the exhaust port of the motorcycle engine. Since screens are available which have the capability of removing eighty percent (80%) of all particles greater than 0.023 inches, spark arrestor 10 meets all of the Federal requirements for use on motorcycles in National Parks.

It is also obvious that spark arrestor 10 is readily cleanable by removing same from the motorcycle exhaust pipe and by passing water through housing 11 in a direction opposite from the direction the exhaust gases had previously flowed therethrough to remove the particles trapped on screen 20. On the other hand, one of the particularly desirable features of spark arrestor 10 is that it is self-cleaning. In other words, with end 12 of housing 11 connected to a motorcycle exhaust pipe, particles will accumulate on one side of screen 20. At a later time, after all of such particles have cooled, housing 11 may be reversed, since it is completely symmetrical and end 13 connected to the motorcycle exhaust pipe. Therefore, while the hot particles are accumulating on the other side of screen 10, the previously cooled and trapped particles will be blown off of the one side of screen 20.

Spark arrestor 10 also solves the problem encountered with previous screen type spark arrestors in that screen 20 has no sharp edges which are subjected to the hot exhaust gases so that screen 20 is long lasting. Furthermore, screen 20 provides virtually no back pressure to the motorcycle engine and is suitable for use in all high performance motorcycles.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A spark arrestor for use with an exhaust pipe comprising:

an elongate housing connectable to said exhaust pipe; and a screen connected in said housing, said screen including a planar, rectangular, central section positioned parallel to the longitudinal axis of said housing and contacting the opposite sides thereof, and first and second planar end sections made integral with the opposite ends of said central section and extending in opposite directions therefrom at obtuse angles thereto of at least 100°, the free ends of said end sections contacting and being connected to said housing.

2. A spark arrestor according to claim 1, wherein said first and second end sections extend in opposite, parallel directions from said central section.

3. A spark arrestor according to claim 2, wherein said end sections extend at obtuse angles of between 100° and 120° relative to said central section.

4. A spark arrestor according to claim 1, wherein said housing is reversible and either end thereof is connectable to said exhaust pipe.

5. A spark arrestor according to claim 1, wherein said housing is cylindrical and said end sections are semi-elliptical.

6. A spark arrestor according to claim 1, wherein the gauge of said screen is sufficient to block at least 80% of all carbon and other particles in said exhaust gases having at least one dimension of 0.023 inches or greater.

* * * * *